United States Patent [19]

Welch et al.

[11] Patent Number: 4,877,109

[45] Date of Patent: Oct. 31, 1989

[54] ADJUSTABLE SAWHORSE AND SCAFFOLD

[76] Inventors: Donald G. Welch, P.O. Box 1040, Hooker, Okla. 73945; Randall N. Barton, 1402 N. Quinn, Guymon, Okla. 73942

[21] Appl. No.: 250,221

[22] Filed: Sep. 28, 1988

[51] Int. Cl.[4] ..... B27B 21/00; B25H 1/06

[52] U.S. Cl. ..... 182/183; 182/184; 182/185; 182/225

[58] Field of Search ..... 182/181, 182, 183, 184, 182/185, 224, 179, 119, 225

[56] References Cited

U.S. PATENT DOCUMENTS

| | | | |
|---|---|---|---|
| D. 279,606 | 7/1985 | Merians | D25/67 |
| D. 280,440 | 9/1985 | Gromer, Jr. | D26/67 |
| 643,969 | 2/1900 | Milne . | |
| 1,225,981 | 5/1917 | Loughridge . | |
| 1,303,416 | 5/1919 | Tidyman . | |
| 1,597,555 | 8/1926 | Tolmie . | |
| 1,838,151 | 12/1931 | Penote | 182/181 |
| 2,194,027 | 3/1940 | McDonald | 182/181 |
| 2,325,592 | 8/1943 | Degler | 182/183 |
| 2,634,172 | 4/1953 | Hollidge | 182/181 |
| 2,637,358 | 5/1953 | Larson . | |
| 2,794,688 | 6/1957 | Scott . | |
| 2,829,927 | 4/1958 | Sword . | |
| 3,266,595 | 8/1966 | Bormann | 182/181 |
| 3,734,235 | 5/1973 | Lanier | 182/153 |
| 4,565,263 | 1/1986 | Southworth | 182/184 |
| 4,756,384 | 7/1988 | Maddox | 182/184 |

*Primary Examiner*—Reinaldo P. Machado

*Attorney, Agent, or Firm*—Laney, Dougherty, Hessin & Beavers

[57] ABSTRACT

An adjustable sawhorse and scaffold assembly. The sawhorse includes a pair of end supports with a horizontal member extending therebetween. The horizontal member may be clamped to the supports at outer ends thereof. Each support comprises a tubular member for receiving the horizontal member with legs extending downwardly therefrom. The legs are telescoping and may be locked at a predetermined length. A horizontal brace is provided on each of the supports and is adapted for receiving a step thereon. A portion of the lock on the telescoping legs prevents pivotation of the board with respect to the braces. A side rail extends from each of the tubular members of the supports, and the side rails are aligned so that an elongated work piece may be clamped therein. The scaffold includes at least a pair of the sawhorses. A beam is positioned in the side rails of each of the sawhorses, and an upper platform is disposed on the beams and attached thereto.

28 Claims, 3 Drawing Sheets

ADJUSTABLE SAWHORSE AND SCAFFOLD

BACKGROUND OF THE INVENTION

1. Field Of The Invention

This invention relates to adjustable sawhorses, and more particularly, to a versatile sawhorse which may be used in a scaffolding system and having a means for mounting a step thereon and also having a side mounting rack.

2. Description Of The Prior Art

A variety of sawhorses have been developed over the course of time, but many of these are not easily adjusted or disassembled. The sawhorse of the present invention is easily adjusted or dismantled and stored, and uses an outwardly positioned clamping means for clamping a horizontal member into end portions thereof. The sawhorse of the present invention is also versatile in that it has a side rail extending therefrom into which elongated members may be positioned and clamped.

Another problem with previous sawhorses is that they are not easily adapted for use in sturdy scaffolding systems. In the present invention, a plurality of the sawhorses may be utilized to hold beams for supporting a platform of a scaffold. Further, the sawhorse includes means for positioning a step thereon with additional means for substantially preventing rotation or pivotation of the step when in position.

SUMMARY OF THE INVENTION

The sawhorse apparatus of the present invention comprises a pair of end supports, each end support comprising a tubular member and a plurality of legs attached to the tubular member and extending downwardly therefrom. The sawhorse further comprises a horizontal member, disposed through the tubular members of the end supports and extending therebetween, and clamping means on each of the tubular members for clamping the horizontal member thereto. Each of the clamping means is preferably positioned on the corresponding tubular member at a position longitudinally outwardly of the legs. The apparatus may also comprise rack means for extending from the tubular members, each of the rack means being aligned and adapted for receiving an elongated work piece therein. Clamping means may also be provided for clamping the work piece in the rack means.

The apparatus may additionally comprise a horizontal brace extending between the legs on each of the end supports, wherein the horizontal brace is adapted for receiving an elongated, substantially flat step thereon such that the step extends between, and is supported by, each of the horizontal braces. Means may be provided for substantially preventing rotation or pivotation of the step when positioned on the horizontal braces or bars.

The legs are preferably telescoping for adjusting the length thereof, and the apparatus comprises locking means for locking the legs in a selected one of a plurality of positions. In the preferred embodiment, it is the locking means which comprises the means for substantially preventing rotation of the step.

Each of the legs may comprise an outer leg portion defining a hole therein and an inner leg portion slidably disposed in the outer leg portion and defining a plurality of holes therein. The locking means preferably comprises a lock housing attached to the outer leg portion adjacent the hole therein, a lock pin movable in the lock housing and having a locking position engaging the hole in the outer leg portion and one of the holes in the inner leg portion, and biasing means for biasing the locking pin toward the locked position.

The sawhorse of the present invention may be one of a pair of such apparatus further comprising a beam attached to each sawhorse apparatus and a platform positioned on the beams and attached thereto to form a scaffold. Stated in another way, the present invention includes a scaffold system comprising a plurality of support assemblies, each of the support assemblies comprising a plurality of aligned central members, a plurality of legs extending downwardly from each of the central members, a plurality of aligned side rails, each of the side rails extending from one of the central members and defining a substantially U-shaped opening therein, a beam disposed in each of the aligned side rails, an upper surface of each of the beams being at least as high as an upper surface of each of the central members, and clamping means on each of the side rails for clamping the beam thereto. The scaffolding system further comprises a substantially horizontal platform extending between each of the beams and engaging the upper surfaces thereof. The platform may be attached to the beams by fastening means of a kind known in the art.

An important object of the present invention is to provide an adjustable sawhorse which may be used in a scaffolding system.

Another object of the invention is to provide a sawhorse having a pair of end supports, a horizontal member, and clamping means on each of the end supports at outward positions thereon.

A further object of the invention is to provide a scaffolding system having rack means extending therefrom for receiving an elongated work piece therein.

Still another object of the invention is to provide a sawhorse having a horizontal member on each end thereof adapted for receiving a step thereon, and preferably including means for substantially preventing pivotation or rotation of the step with respect to the horizontal members.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1:
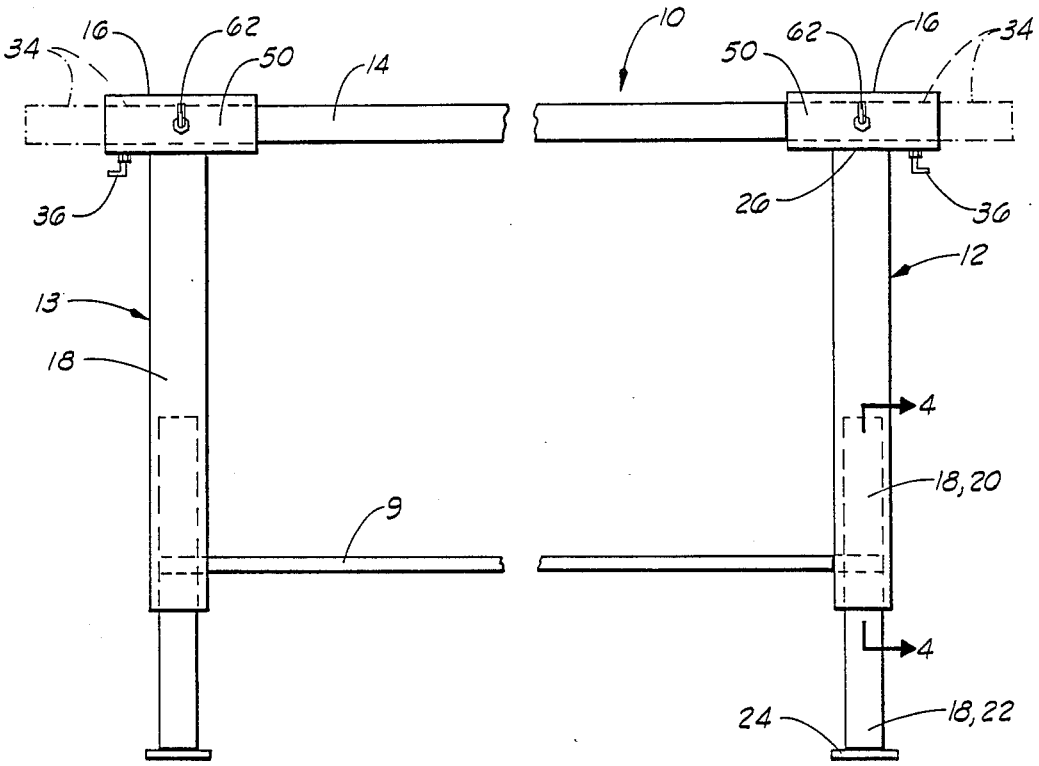
FIG. 1 is a side view of the adjustable sawhorse of the present invention.
Figure 2:
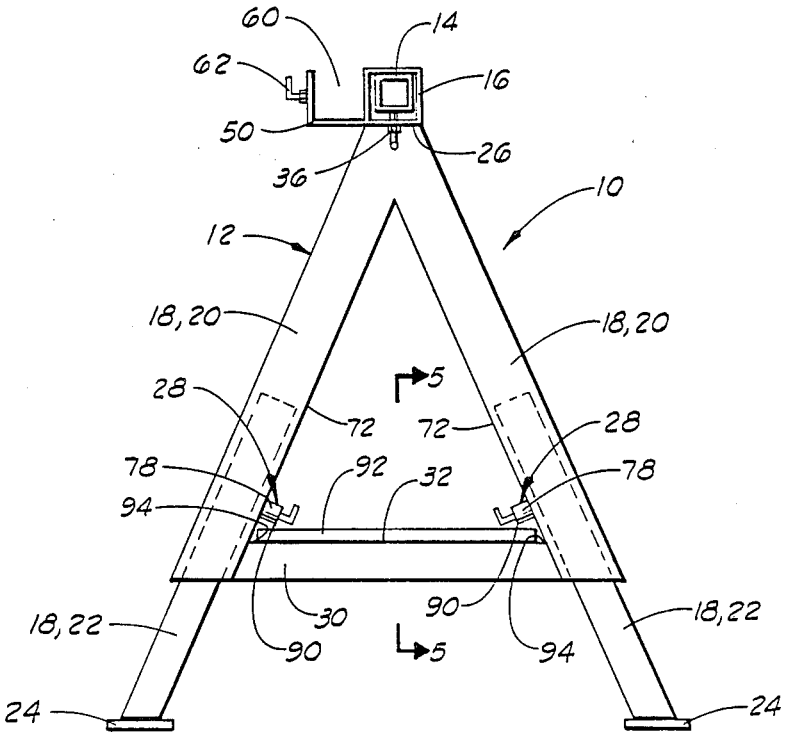
FIG. 2 is an end view of the sawhorse.

Referring now to the drawings, and more particularly to FIGS. 1 and 2, the adjustable sawhorse of the present invention is shown and generally designated by the numeral 10. In the configuration shown in FIGS. 1 and 2, sawhorse 10 comprises a pair of supports 12 and 13 with a substantially horizontal member or beam 14 extending therebetween.

As noted hereinafter, supports 12 and 13 are very similar, and therefore, only the details of support 12 will be discussed initially. Each support 12 preferably includes an elongated tubular member or tube 16 with a pair of legs 18 extending downwardly therefrom. Tube 16 may also be referred to as a central member 17 of support 12. As seen in the end view of FIG. 2, legs 18 extend angularly and downwardly in a transverse direction from tube 16. As seen in FIG. 1, however, each pair of legs 18 is in a plane substantially perpendicular to tube 16. Legs 18 are positioned at approximately the longitudinal center of the corresponding tube 16.

Referring again to FIG. 2, each leg 18 includes an outer leg portion 20 and an inner leg portion slidably disposed in the outer leg portion. Preferably, both outer leg portion 20 and inner leg portion 22 are of substantially tubular construction having a substantially square cross section, although other cross-sectional configurations could also be used. A the lower end of each inner leg portion 22 is a foot pad 24 adapted for flatly engaging a ground surface. In other words, foot pad 24 is substantially parallel to lower side 26 of tube 16. Inner leg portion 22 may be variably positioned with respect to the corresponding outer leg portion 20 of each leg 18. As will be discussed further herein, a locking means 28 is attached to each outer leg portion 20 for lockingly engaging inner portion 22 in any one of a number of relative positions with respect to outer leg portion 20. Thus, each leg 18 is a locking, telescoping leg which allows tube 16 to be adjusted with respect to the ground surface.

Interconnecting the lower ends of each pair of outer leg portions 20 is a substantially horizontal brace, bar or support 30. Brace 30 is also preferably a tubular member having a substantially square cross section having an upper planar surface 32.

Horizontal member 14 is sized to slidably fit within tube 16 of support 12. Ordinarily, each support 12 is positioned such that the tube 16 thereof is positioned adjacent an end 34 of horizontal member 14. However, as shown by the phantom lines in FIG. 1, supports 12 may be positioned such that they are spaced from ends 34 of horizontal member 14, as desired. It should also be understood that, while two supports 12 are shown adjacent ends 34 of horizontal member 14 to form a generally conventional sawhorse configuration, additional supports 12 may be positioned along horizontal member 14 between the outermost supports 12. That is, more than two supports 12 may be used as desired depending upon the length of horizontal member 14 and the amount of support that is necessary for the particular use. Horizontal member 14 is preferably a tubular member of substantially square cross section, although other cross-sectional configurations or a solid member could also be used.

Figure 3:
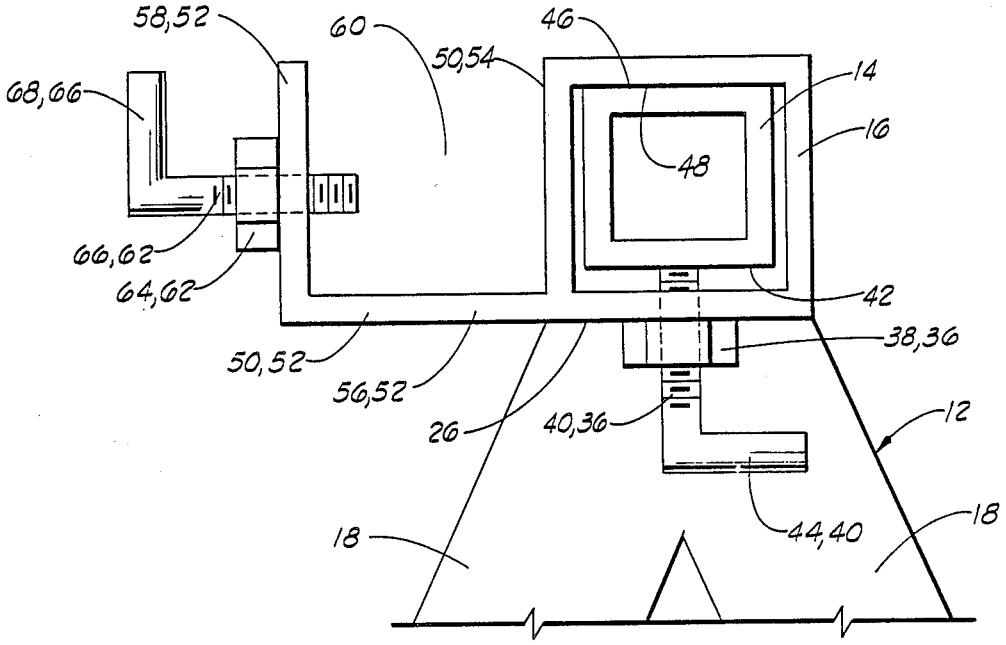
FIG. 3 is an enlarged end view of a support member of the sawhorse showing details of clamping means and rack means thereon.

Referring now also to FIG. 3, a clamping means 36 is provided for clamping horizontal member 14 within tube 16. In the preferred embodiment, clamping means 36 comprises an internally threaded member or nut 38 which is fixedly attached to lower side 26 of tube 16 and a thumb screw 40 threadingly engaged with nut 36 and extending upwardly through lower side 26 of tube 16 to engage lower side 42 of horizontal member 14. Thumb screw 40 has a finger portion extending therefrom so that the thumb screw can be easily rotated. It will be seen by those skilled in the art that thumb screw 40 may be threaded into nut 38 to engage lower side 42 of tube 14 and force the tube upwardly such that upper side 46 thereof engages inner surface 48 in tube 16. It will also be seen that horizontal member 14 has an outer circumference which is slightly smaller than the inner circumference of tube 16.

Extending transversely from tube 16 is a rack means 50 for supporting an object therein. Rack means 50 preferably comprises an L-shaped member 52 and a vertical side 54 of tube 16. L-shaped member 52 forms a side rail having a substantially horizontal portion 56 which is aligned with lower side 26 of tube 16 and a substantially vertical portion 58 which is spaced from and generally faces side 54 of tube 16. Thus, a substantially U-shaped rack opening 60 is defined by rack means 50.

A clamping means 62 is provided for clamping an object in opening 60 of rack means 50. Preferably, clamping means 62 is substantially identical to clamping means 36 and comprises a threaded member or nut 64 and a thumb screw 66 which is threadingly engaged with nut 64 and extends into opening 60. As with thumb screw 40 of clamping means 36, thumb screw 66 of clamping means 62 has a finger portion 68 extending therefrom. Thumb screw 66 is threaded into nut 64 to engage an object in opening 60 of rack means 50 in a manner very similar to the engagement of clamping means 40 with horizontal member 14 in tube 16.

Supports 12 and 13 are of substantially similar configuration, and differ only in that the rack means 50 on each extends in the same direction with respect to sawhorse 10. That is, when seen from the end view of FIG. 2, the rack means 50 of supports 12 and 13 are aligned. Thus, an elongated object, such as a board, pipe or other item may be positioned longitudinally in sawhorse 10 and located in opening 60 of each rack means 50 and clamped therein by the corresponding clamping means 62. In this way, sawhorse 10 provides for rigidly holding a work piece thereon, unlike normal sawhorses. As will be discussed in more detail hereinafter, this makes sawhorse 10 ideally suited for a support assembly for a scaffold system.

Figure 4:
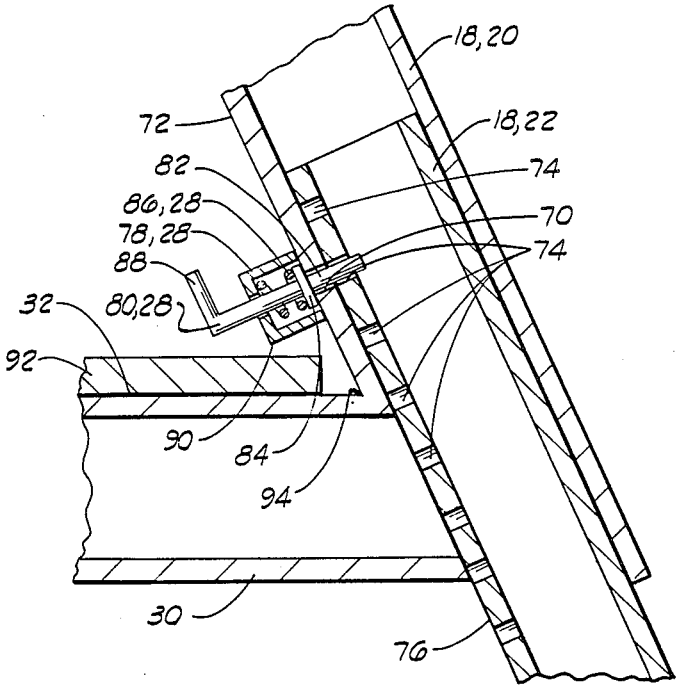
FIG. 4 is a partial cross section taken along lines 4—4 in FIG. 1.

Referring now to FIG. 4, the interaction of inner leg portion 22 with outer leg portion 20 of legs 18 is shown, along with details of locking means 28. Outer leg portion 20 defines a hole 70 in a downwardly facing side 72 thereof. Inner leg portion 22, which is slidably disposed in outer leg portion 20 as previously described, defines a plurality of spaced holes 74 through a downwardly facing side 76 thereof. Each of holes 74 in inner leg portion 22 may be selectively aligned with hole 70 in outer leg portion 20.

Locking means 28 is positioned on downwardly facing side 72 of outer leg portion 20 adjacent hole 70. In the preferred embodiment, locking means 28 comprises a hollow lock housing 78 attached to side 72 of outer leg portion 20. A lock pin 80 extends through lock housing 78 and has an end portion 82 which extends through aligned holes 70 and 74 when locking means 28 is in a locking position. Lock pin 80 also has a flange 84 extending outwardly therefrom. A biasing means, such as spring 86, is positioned in lock housing 78 for engaging flange 84 and biasing lock pin 80 to the locking position shown in FIG. 4. Lock pin 80 further includes a finger portion 88 extending from an outer end thereof. It will be seen by those skilled in the art that by pulling on finger portion 88, lock pin may be retracted such that end portion 82 is no longer engaged with hole 74 in inner leg portion 22 so that the inner leg portion may be repositioned as desired. Once hoe 70 is realigned with a hole 74 and lock pin 80 released, spring 86 will relock locking means 28.

Figure 5:
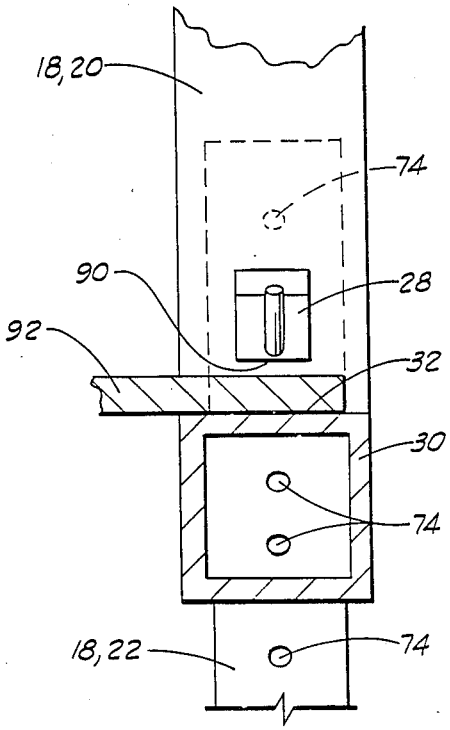
FIG. 5 is a partial cross section taken along lines 5—5 in FIG. 2.

Referring now to FIGS. 2, 4 and 5, lock means 28 has a lowermost edge 90, which in the preferred embodiment is the lowermost edge of lock housing 78, which is spaced above upper surface 32 on brace 30 of support 12 or 13. This spacing between edge 90 and upper surface 32 is predetermined such that a board 92 or other elongated flat member may be positioned therein. Further, facing corners 94 are defined at the intersection of upper surface 32 of brace 30 with downwardly facing sides 72 of opposite outer leg portions 20. The horizontal spacing between opposite corners 94 is also such that board 92 will fit closely therebetween. Thus, a board of sufficient width may be positioned on brace 30 of each of supports 12 and 13, the board also being of sufficient length to extend therebetween. In this way, board 92 may be added to sawhorse 10 to provide a step.

Because of the relatively small size of horizontal member 14, a person may step onto board 92 and not be prevented from doing so by horizontal member 14. In fact, horizontal member 14 may be used as a rail for the person to lean against or to hold onto as desired. Because of the predetermined spacing between corners 94 compared to the width of board 92, board 92 will not appreciably move transversely with respect to to sawhorse 10. Further, the vertical spacing between edge 90 and upper surface 32 compared to the thickness of board 92 is such that the board cannot move appreciably upwardly within supports 12 and 13. Thus, a means is provided for preventing pivotation or rotation of board 72 as a person steps on the edge thereof.

Figure 6:
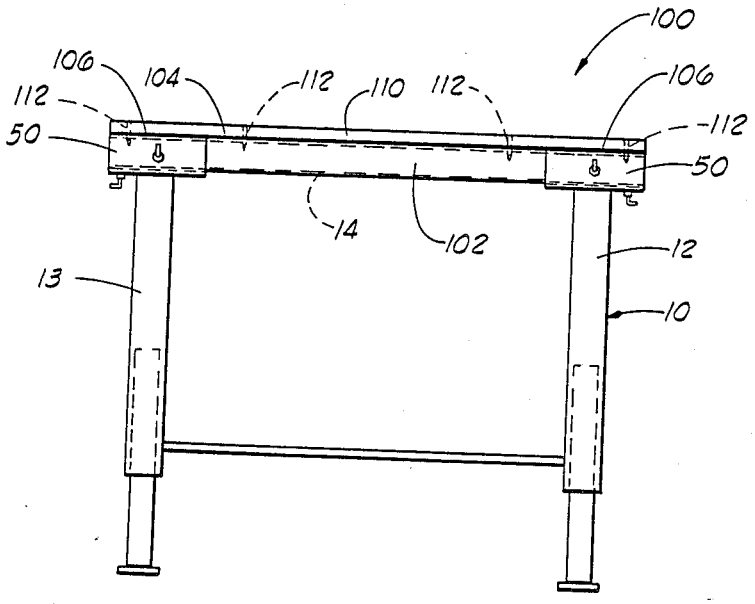
FIG. 6 illustrates a side view of a scaffolding system of the present invention utilizing a pair of sawhorses.
Figure 7:
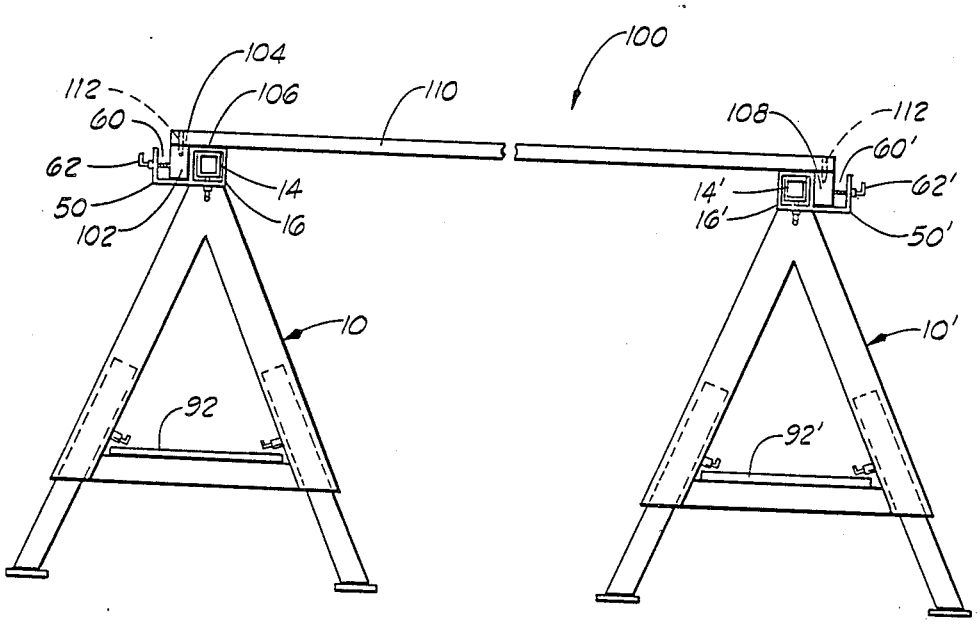
FIG. 7 is an end view of the scaffolding system of FIG. 6.

Referring now to FIGS. 6 and 7, the scaffold system of the present invention is shown and generally designated by the numeral 100. It will be readily evident that the scaffold system as illustrated utilizes a pair of sawhorses 10 and 10′ which act as support assemblies for the scaffold system. Sawhorses 10 and 10′ are positioned, and the legs thereof are adjusted and locked in the desired position, as previously described. Also a board 92 may be positioned on either or both of sawhorses 10 and 10′ to provide a step, also as previously described. Sawhorses 10 and 10′ are preferably positioned such that rack means 50 and 50′ thereof are positioned in opposite directions, as best seen in FIG. 7. A beam 102 is positioned in rack means 50 on each of supports 12 and 13 and clamped therein by clamping means 62. Beam 102 may be made of a conventional member such as a board. Preferably, an upwardly facing side 104 of beam 102 is aligned with, or at least as high as, upwardly facing side 106 of tubes 16. In the preferred embodiment, the depth of opening 60 in rack means 50 is dimensioned such that a standard 2×4 board may be placed on edge in opening 60 so that the upwardly facing side 104 of the board is substantially aligned with upwardly facing side 106 of tube 16.

A substantially identical beam 108 is locked into opening 60′ of rack means 50′ by clamping means 62′ on sawhorse 10′. An upper platform or plank 110 is positioned on top of sawhorses 10 and 10′ as shown in FIGS. 6 and 7. Platform 10′ is attached to beams 102 and 108 by fastening means 112 of a kind known in the art. For example, fastening means 112 may be characterized by nails, screws or the like. Because upwardly facing sides 104 of beams 102 and 108 are aligned with upwardly facing sides 106 of tube 16, platform 110 will rest flatly on these upwardly facing surfaces, and thus be well supported thereby.

It will be seen by those skilled in the art that a strong, quickly assembled scaffolding structure 100 is thus provided. A person may easily step u onto platform 110 by first stepping onto the step provided by boards 92 or 92′ If the span of platform 110, as shown in FIG. 7, is sufficiently long, an additional sawhorse, identical to sawhorses 10 or 10′, may be positioned between sawhorses 10 and 10′, although this has not been specifically illustrated in FIG. 7. In this way, the additional sawhorse provides intermediate support for platform 110. A beam may be positioned in that sawhorse and attached to the intermediate position on platform 110 by additional fastening means 112.

It will be seen, therefore, that the adjustable sawhorse and scaffold of the present invention is well adapted to carry out the ends and advantages mentioned as well as those inherent therein. While a presently preferred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. A sawhorse apparatus comprising:

a pair of end supports, each end support comprising:
a longitudinally extending tubular member; and
a plurality of legs attached to said tubular member and extending downwardly therefrom;

a horizontal member disposed through said tubular members of said end supports and having a portion extending longitudinally inwardly between said tubular members; and clamping means on each of said tubular members for clamping said horizontal member thereto, each clamping means being positioned on the corresponding tubular member at a position longitudinally outwardly of said legs.

2. The apparatus of claim 1 further comprising rack means for extending from each of said tubular members, each of said rack means being aligned and adapted for receiving an elongated work piece therein.

3. The apparatus of claim 2 further comprising clamping means for clamping said work piece in said rack means.

4. The apparatus of claim 1 further comprising a horizontal brace extending between said legs on each of said end supports, said horizontal brace being adapted for receiving an elongated, substantially flat step thereon such that said step extends between, and is supported by, each of said horizontal braces.

5. The apparatus of claim 4 further comprising means for substantially preventing rotation of said step when positioned on said horizontal braces.

6. The apparatus of claim 1 wherein said legs are telescoping for adjusting the length thereof.

7. The apparatus of claim 6 further comprising locking means for locking said legs in a selected one of a plurality of positions.

8. The apparatus of claim 7 further comprising a horizontal brace extending between said legs and adapted for receiving a step thereon.

9. The apparatus of claim 8 wherein said locking means comprises a portion spaced from said brace such that said step may be positioned therebetween and for substantially preventing rotation of said step with respect to said horizontal brace.

10. A sawhorse apparatus comprising:
a plurality of substantially A-shaped supports, each support comprising:
an elongated tube;
a plurality of legs extending downwardly from each of said tubes, said legs being telescoping;
locking means for locking said legs in a variable operating position; and
a horizontal bar extending between said legs;
a horizontal member positioned through each of said tubes and extending therebetween; and
a step positioned on each of said horizontal bars and extending therebetween, wherein said locking means is adapted for substantially preventing pivotation of said step with respect to said horizontal bars.

11. The sawhorse of claim 10 further comprising means for clamping said horizontal member to said tubes.

12. The apparatus of claim 10 wherein:
each of said legs comprises:
an outer leg portion defining a hole therein; and
an inner leg portion slidably disposed in said outer leg portion and defining a plurality of holes therein; and
said locking means comprises:
a lock housing attached to said outer leg portion adjacent said hole therein;
a lock pin movable in said lock housing and having a locking position engaging said hole in said outer leg portion and one of said holes in said inner leg portion; and
biasing means for biasing said locking pin toward said locked position.

13. The sawhorse of claim 10 further comprising a side rail extending from each of said tubes, said side rails being aligned for receiving an elongated work piece therein.

14. The sawhorse of claim 13 further comprising clamping means for clamping said work piece in said side rails.

15. The apparatus of claim 10 wherein said legs on each of said end members is in a plane substantially perpendicular to the corresponding tube of said end members.

16. A scaffold system comprising:
a plurality of support assemblies, each of said support assemblies comprising:
a plurality of aligned central members;
a plurality of legs extending downwardly from each of said central members;
a plurality of aligned side rails, each of said side rails extending from one of said central members and defining a substantially U-shaped opening therein;
a beam disposed in said aligned side rails, an upper surface of each of said beams being at least as high as an upper surface of each of said central members; and
clamping means on each of said side rails for clamping said beam therein; and
a substantially horizontal platform extending between each of said beams and engaging said upper surfaces thereof.

17. The scaffold of claim 16 wherein each of said central members is a tubular member and further comprising a horizontal member extending between said tubes in each of said support assemblies.

18. The scaffold of claim 17 further comprising clamping means for clamping said horizontal member to each of said tubular members.

19. The scaffold of claim 16 further comprising:
a horizontal step support extending between said legs on each of said support assemblies; and
a step positioned on said horizontal step supports of at least one of said support assemblies.

20. The scaffold of claim 19 further comprising means for substantially preventing pivotation of said step with respect to said horizontal step supports.

21. The scaffold of claim 16 wherein said legs are adjustable in length and further comprising locking means for locking each of said legs in a predetermined position.

22. The apparatus of claim 21 further comprising:
a horizontal step support extending between said legs on each of said support assemblies; and
a step positioned on said horizontal step supports of at least one of said support assemblies.

23. The apparatus of claim 22 wherein said locking means comprises means for substantially preventing pivotation of said step with respect to said horizontal step support.

24. A sawhorse apparatus comprising:
a pair of end supports, each end support comprising:
a tubular member; and
a plurality of legs attached to said tubular member and extending downwardly therefrom;
a horizontal member disposed through said tubular members of said supports and extending therebetween; and
clamping means on each of said tubular members for clamping said horizontal member thereto, each clamping means being positioned on the corresponding outwardly tubular member at a position longitudinally outwardly of said legs;
wherein, said sawhorse apparatus is one of a pair of such apparatus further comprising:
a beam attached to each of said sawhorse apparatus; and
a platform positioned on said beams and attached thereto.

25. A sawhorse comprising:
a plurality of substantially A-shaped supports, each support comprising:
an elongated tube;
a plurality of legs extending downwardly from each of said tubes, said legs being telescoping and comprising:
an outer leg portion defining a hole therein; and
an inner leg portion slidably disposed in said outer leg portion and defining a plurality of holes therein; and
locking means for locking said legs in a variable operating position, said locking means comprising:
a lock housing attached to said outer leg portion adjacent said hole;
a lock pin movable in said lock housing and having a locking position engaging said hole and said outer leg portion and one of said holes in said inner leg portion; and biasing means for biasing said locking pin toward said locked position;

a horizontal member positioned through each of said tubes and extending therebetween; and a step positioned on each of said horizontal bars and extending therebetween;

wherein, each of said lock housings has an edge spaced from a corresponding one of said horizontal bars for receiving said step therebetween such that said step is substantially prevented from rotating with respect to said horizontal bars.

26. A sawhorse comprising:

a plurality of substantially A-shaped supports, each support comprising:

an elongated tube;

a plurality of legs extending downwardly from each of said tubes; and a horizontal bar extending between said legs;

a horizontal member positioned through each of said tubes and extending therebetween; and a step positioned on each of said horizontal bars and extending therebetween;

wherein, said sawhorse is one of a pair of said sawhorses and further comprising:

a beam attached to each of said sawhorses; and a platform positioned on said beams and attached thereto.

27. An apparatus comprising:

a plurality of sawhorse apparatus, each of said sawhorse apparatus comprising:

a pair of end supports, each end support comprising:

a tubular member; and a plurality of legs attached to said tubular member and extending downwardly therefrom;

a horizontal member disposed through said tubular members of said end supports and extending therebetween; and clamping means on each of said tubular members for clamping said horizontal member thereto, each clamping means being positioned on the corresponding tubular member at a position longitudinally outwardly of said legs;

a beam attached to each of said sawhorse apparatus; and a platform positioned on said beams and attached thereto.

28. An apparatus comprising:

a plurality of sawhorses, each of said sawhorses comprising:

a plurality of substantially A-shaped supports, each support comprising:

an elongated tube;

a plurality of legs extending downwardly from each of said tubes; and a horizontal bar extending between said legs;

a horizontal member positioned through each of said tubes and extending therebetween; and a step positioned on each of said horizontal bars and extending therebetween;

a beam attached to each of said sawhorses; and a platform positioned on said beams and attached thereto.

* * * * *